United States Patent [19]

Tesinsky

[11] 3,948,484

[45] Apr. 6, 1976

[54] TRANSFER CASE ASSEMBLY REMOVAL TOOL

[76] Inventor: William J. Tesinsky, Box 75, Stockett, Mont. 59480

[22] Filed: Dec. 20, 1974

[21] Appl. No.: 534,870

[52] U.S. Cl. ..... 254/134
[51] Int. Cl.[2] ..... B66F 13/00
[58] Field of Search ..... 254/133, 134; 214/1 D

[56] References Cited

UNITED STATES PATENTS

| | | | |
|---|---|---|---|
| 2,583,114 | 1/1952 | Monteith | 214/1 D |
| 2,806,613 | 9/1957 | Johnson | 214/1 D |
| 2,837,222 | 6/1958 | Trautman | 214/1 D |
| 3,145,971 | 8/1964 | Bobbitt | 214/1 D |
| 3,628,772 | 12/1971 | Gaarder | 254/134 |
| 3,851,857 | 12/1974 | Notgrass | 254/134 |

*Primary Examiner*—Al Lawrence Smith
*Assistant Examiner*—Robert C. Watson

[57] ABSTRACT

A transfer case assembly removal tool adapted to be coupled with a jack utilizing a tiltable cradle which may be directly bolted to a transfer case. After the transfer case is bolted to the cradle, bolts which secure the transfer case to a transmission are removed and the transfer case may be transported to a work bench or other area for repair.

2 Claims, 3 Drawing Figures

Fig. 1.
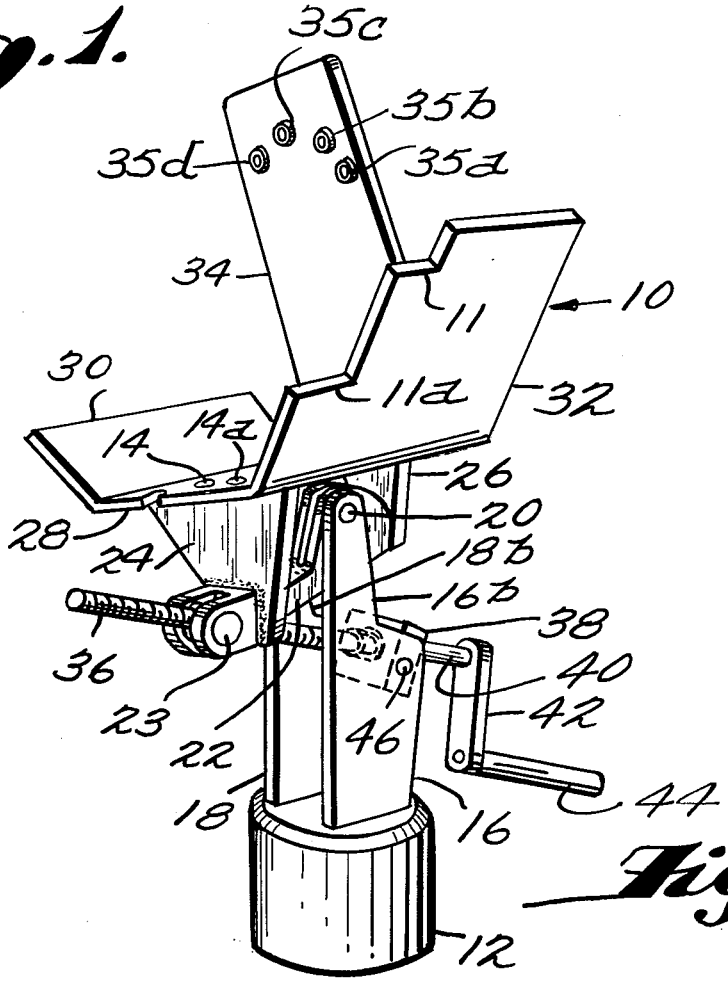
Fig. 2.
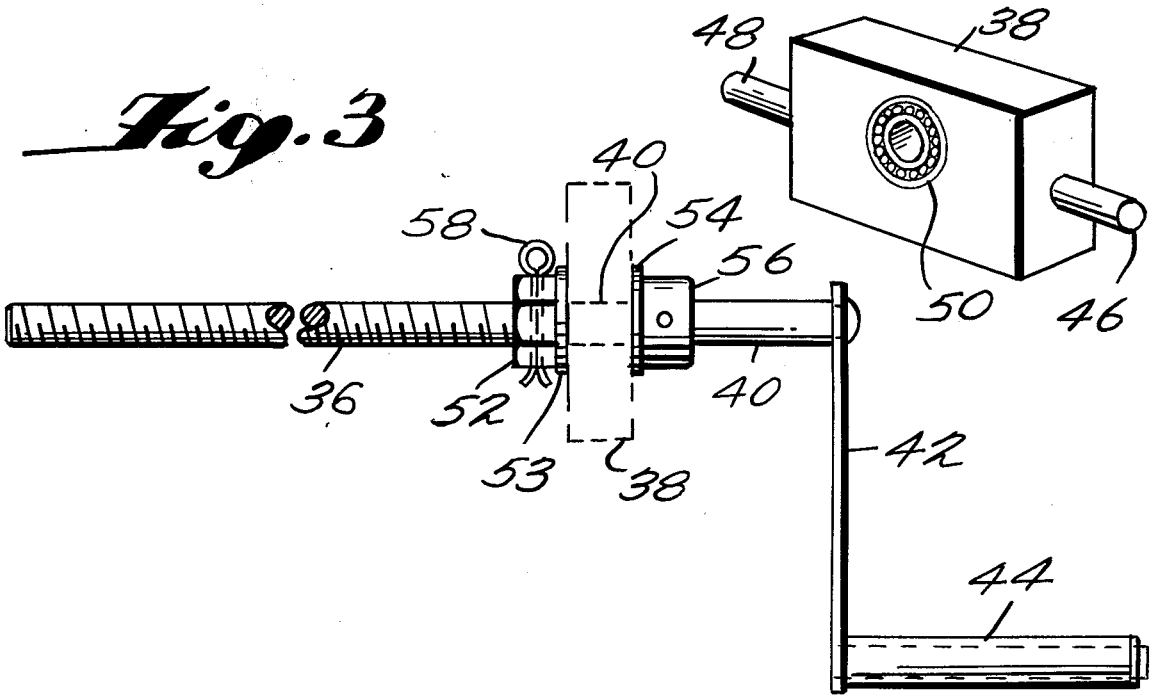
Fig. 3

TRANSFER CASE ASSEMBLY REMOVAL TOOL

BACKGROUND OF THE INVENTION

A. Field of the Invention

The present invention relates to a device for removing a transmission of other gear cases from vehicles and more particularly, to a cradle or tool supported by a mobile jack for use in removing a transfer case from a vehicle.

Many commercial and recreational vehicles in use today require the addition of front wheels as driving members to supply more traction. Such vehicles are commonly referred to as four wheel drive vehicles. A transfer assembly or case provides an auxiliary rear train to enable the power to be divided or transferred to both forward and rear propeller shafts. A transfer case also provides a means of lowering the power train components sufficiently to permit the forward propeller shaft to clear the engine crank case. A typical transfer case is essentially a two-speed transmission unit (low and direct drive), but may include an additional gear reduction. Transfer assemblies are typically mounted onto and below the transmission of a vehicle.

Because a transfer assembly comprises a plurality of mesh and sliding gears, it is inevitable that after a certain period of operating time, mechanical failures necessitating repair will occur. A common probem arises when it is desired to remove a transfer assembly from a transmission. Typically, the vehicle is hoisted up by a commercial hydraulic lift so that a mechanic may stand underneath the vehicle to work on the transfer case assembly. Transfer case assemblies are extremely heavy and awkward to handle, and some means for supporting the assembly while it is being uncoupled from the transmission is imperative.

The present invention solves the problems involved in removing a transfer case to enable a single mechanic to rapidly and safely remove a transfer case assembly from a transmission so that it may be transported to a suitable area for repair.

B. Description of the Prior Art

It is known in the prior art to provide an assembly on a mobile jack which aids in the removal of a transmission or the like. One such assembly is disclosed in U.S. Pat. No. 3,168,286 wherein a generally U-shaped bracket is mounted on a wheeled jack and which employs a collar adapted to be placed on top of the jack. Vertically extending arms having apertures adapted to receive bolts from a transmission or other device to be removed are arranged on the collar. The jack head assembly is then securely attached to a transmission for removal. It is readily apparent from a consideration of U.S. Pat. No. 3,168,286 that the device therein disclosed could not readily be adapted to remove a transfer case assembly. A larger cradling device would be required because of the weight of a transfer case assembly, and furthermore some means for pivoting or tilting and jack head assembly would also be required in order to facilitate removal of the transfer case.

In U.S. Pat. No. 2,749,089 there is disclosed a transmission cradle for rigidly and securely clamping onto a transmission of an automobile so that the transmission may be removed from or replaced onto the vehicle. In this patent, the cradle is securely attached to a jack and means are provided to accommodate various sizes of transmission cases to be removed. Pointed screw ends are threadedly arranged in a curved bar secured to a jack head assembly. Depending upon the orientation of the threaded pointed ends, different sized transmissions may be cradled within the curved bar against the pointed ends. However, to rigidly secure a transmission to the cradle or curved bar, a continuous chain is required to be attached from an extension of the curved bar and wrapped around the transmission. Such a device is relatively cumbersome in that some effort must be made to encircle the transmission with the chain. Also, U.S. Pat. No. 2,749,089 does not disclose a means for pivoting the curved bar so that the transmission could be moved past obstructions underneath the vehicle.

Yet another example of a prior art device for attachment to a jack is disclosed in U.S. Pat. No. 3,628,772. This patent describes a load carrying and positioning head for use in connection with a jack in which a plurality of arms are carried by a platform and are shiftable with respect thereto for clamping engagement with a load. Furthermore, there are chains provided with the platform for retaining the load when the platform is tilted.

Another prior art device to be considered as relevant is disclosed in U.S. Pat. No. 2,747,837. Here, there is described a transmission lifting attachment for use on a mobile lifting jack. The attachment may be used for lifting hydraulic transmissions and holding them at various angles during the servicing or repair thereof. However, it is to be noted that this patent does not disclose a device which uses the transmission bolts to secure the transmission to the device for removal from a vehicle.

In U.S. Pat. No. 3,040,908 there is disclosed an equipment handling device in which a cradle assembly is secured to a hydraulic jack in order to lift, lower and support mechanical components such as transmissions and differential assemblies of motor vehicles. The device is adapted to be coupled with a conventional jack and employs generally L-shaped extension elements arranged in a triangular configuration to support a transmission. A chain is extended between the elements to secure the transmission. This patent does not set forth a device for bolting the transmission to a cradle as is set forth in the present invention.

SUMMARY OF THE INVENTION

It is an object of the present invention to provide a transfer case assembly removal device or tool adapted to be coupled with a conventional lifting jack, the device utilizing a cradle which may be directly bolted to a transfer case. After the transfer case is bolted to the cradle, bolts which secure the transfer case to a transmission are then removed and the transfer case may be transported to a work bench or other area for repair.

It is another object of the present invention to provide a transfer case assembly removal device which may be tilted fore and aft about a pivot point to facilitate removal of the transfer case assembly from beneath a motor vehicle.

It is yet another object of the present invention to provide a transfer case assembly removal device which directly cradles a transfer case assembly and does not require the use of additional chains or the like for securing purposes.

Additional objects of the present invention reside in the specific construction of the exemplary apparatus hereinafter particularly described in the specification and shown in the several drawings.

BRIEF DESCRIPTION OF THE DRAWINGS

Novel features of the improved transfer case assembly removal device in accordance with the present invention will be more readily understood from a consideration of the following description taken together with the accompanying drawings, in which a preferred adaptation is illustrated with the various parts thereof identified by suitable reference characters in each of the views, and in which:

FIG. 1 is an isometric view of the removal device of the present invention;

FIG. 2 is a view of a swivel block which is used in conjunction with a hand crank for tilting the device fore and aft; and FIG. 3 is an enlarged, isolated view of the hand crank.

DETAILED DESCRIPTION OF THE INVENTION

FIG. 1 of the drawings is a perspective view of the device generally designated at 10. A hollow, generally cylindrical base portion 12 is constructed to fit over the head of an extension rod of a typical hydraulic jack (not shown). Upright side plates 16 and 18 are welded to base portion 12. Side plates 16 and 18 are constructed from, for instance, ⅝ inch steel plates.

An aperture 16*a* is provided in upright portion 16*b* of side plate 16. A corresponding aperture (not shown) is provided in upright portion 18*b* of side plate 18. A steel roll pin 20 is inserted therethrough to pivotally secure cradle pivot arm 22. Arm 22 is welded onto or otherwise attached to support brackets 24 and 26 which depend from and which are welded to a bottom cradle plate 28.

Cradle plate 28 further comprises angularly disposed cradling walls 30 and 32 which are bent from plate 28 or may be separately welded onto plate 28. Plate 28 may be advantageously constructed from ¼ inch steel plate material. Extending upwardly in a substantially vertical plane from plate 28 is a rear securing member 34. Securing member 34 is provided with a plurality of drilled holes 35*a*, 35*b*, 35*c* and 35*d*. These holes are arranged on securing member 34 to directly line up with bolts which hold a cover on the back or rear side of a particular transfer case assembly.

Notches 11 and 11*a* are arranged to permit cradling wall 32 to fit around projections which exist on various transfer cases.

Additional features of the present invention reside in the means for pivoting cradle plate 28 about roll pin 20. At a forward end of arm 22 there is provided a threaded pin 23 through which an elongated threaded rod or bolt 36 is threadedly inserted. Threaded bolt 36 is further disposed through a swivel block 38 (see FIG. 2) and extends to a shaft 40 having a crank 42 and crank handle 44. Swivel block 38 is arranged for small pivotal movement with respect to upright side plates 16 and 18 by means of swivel pins 46 and 48. Swivel block 38 provides a support for crank 42, 44 and shaft 40 when threaded bolt 36 is rotated through pin 23 to tilt cradle plate 28 either fore or aft. Pins 46 and 48 are pressed into swivel block 38 and squeeze tightly against an inlaid sealed bearing 50 through which shaft 40 extends.

From a consideration of FIG. 3, it can be seen that bolt 38 and shaft 40 are secured to swivel block 38 by means of a nut 52 and washers 53 and 54. An abutment

56 is secured to shaft 40 and nut 52 is secured to rod 36 by means of a cotter key 58.

The use and operation of the transfer case assembly removal device to remove a typical transfer case will now be described. Initially, the device 10 is placed over the head of a typical hydraulic jack so that base portion 12 is inserted over the raising element of the jack. The vehicle from which the transfer case assembly is to be removed is supported upon a hydraulic lift so that the transfer case assembly is sufficiently elevated from the ground so that the jack and the removal device may be disposed thereunder. The bolts which hold the back and bottom covers onto the transfer case assembly are then removed. Cradle portion 28 is then raised into position so that apertures 35*a*, 35*b*, 35*c* and 35*d* are aligned with respective bolt holes of the back cover. the front and rear cover bolts which have been removed are then inserted through the aforementioned apertures and tightened so that cradle plate 28 and member 34 are tightly secured to the transfer case. For further adjustment of the device onto the transfer case, hand crank 44 is operated to tilt cradle 28 forwardly or rearwardly so that the transfer case is cradled therein. At this point, the bolts which hold the transfer case onto the transmission are removed thereby freeing the transfer case from the transmission. Cradling walls 30 and 32 provide lateral support for preventing the transfer case from tipping off cradle plate 28. Hand crank 44 is then further rotated to operatively tilt the transfer case out of the way of cross members or other obstructing parts of the vehicle. The transfer case may then be readily and safely transported by means of the mobile jack to a work bench or other area for repair work.

A similar reverse procedure is repeated when it is desired to install a transfer case onto a transmission.

The bolts which are inserted through apertures 35*a* – 35*d* may be conveniently disposed within apertures 14 and 14*a* when not in use.

It must be remembered that there are many different transfer cases on the market today. These transfer cases have different cover plate bolt holes and thus it is apparent that apertures 35*a* – 35*d* are necessarily arranged for a particular transfer case assembly.

While the invention has been particularly shown and described with reference to the foregoing preferred embodiment thereof, it will be understood by those skilled in the art that other changes in form and detail may be made therein without departing from the spirit and scope of the invention. For instance, the transfer case assembly removal device of the present invention could be readily used to remove transmissions or other vehicle components.

What is claimed is:

1. A tool for mounting onto a jack for supporting and securing a transfer case to be installed or removed from the transmission of a vehicle, said tool comprising a. means for cradling a transfer case comprising a bottom plate, a pair of cradling walls extending from opposite sides from said bottom plate at an angle of more than 0° and less than 90°, and a rear plate extending upwardly from said bottom plate and being substantially normal to said bottom plate, said rear plate and side walls being unconnected to each other except by said bottom plate, b. means for directly securing a transfer case to said cradling means, said securing means comprising means defining a plurality of apertures in said rear plate for receipt of bolts attachable to the transfer case to secure said rear plate to the transfer case, c. a base member for mounting said tool onto a jack, and d. means for pivoting said cradling means about a substantially horizontal axis so that a transfer case secured thereto may be swung away from vehicle parts obstructing removal of the transfer case, said pivoting means comprising a pivot arm operatively connected to said cradling means bottom plate, a threaded pin operatively connected to said pivot arm, an elongated bolt threaded along most of the length thereof and disposed through said threaded pin and having a crank handle attached at one end thereof, a pair of side plates attached to said base and extending upwardly therefrom said side plates straddling said pivot arm and said elongated bolt, a roll pin pivotally connecting said pivot arm to said side plates, and a swivel block pivotally received between said side plates and receiving a non-threaded portion of said threaded bolt therein, said swivel block allowing relative rotary movement between it and said threaded bolt but not allowing relative longitudinal movement therebetween.

2. A tool as recited in claim 1 further comprising means for holding bolts for ready access to be passed through said cradling means rear plate into a transfer case, said means comprising means defining a plurality of apertures in said cradling means bottom plate.

* * * * *